US009589758B2

(12) United States Patent
Tatsuda et al.

(10) Patent No.: US 9,589,758 B2
(45) Date of Patent: Mar. 7, 2017

(54) VACUUM TUBE

(71) Applicants: NORITAKE ITRON CORPORATION, Mie (JP); NORITAKE CO., LIMITED, Aichi (JP)

(72) Inventors: Kazunori Tatsuda, Mie (JP); Tadami Maeda, Mie (JP); Misa Yamanaka, Mie (JP)

(73) Assignees: NORITAKE ITRON CORPORATION, Mie (JP); NORITAKE CO., LIMITED, Aichi (JP)

( * ) Notice: Subject to any disclaimer, the term of this patent is extended or adjusted under 35 U.S.C. 154(b) by 0 days.

(21) Appl. No.: 15/000,392

(22) Filed: Jan. 19, 2016

(65) Prior Publication Data

US 2016/0211107 A1 Jul. 21, 2016

(30) Foreign Application Priority Data

Jan. 20, 2015 (JP) ..... 2015-008345

(51) Int. Cl.

| | |
|---|---|
| ***H01J 21/06*** | (2006.01) |
| ***H01J 19/70*** | (2006.01) |
| ***H01J 19/32*** | (2006.01) |
| ***H01J 19/38*** | (2006.01) |
| ***H01J 21/10*** | (2006.01) |

(52) U.S. Cl.

CPC ..... *H01J 21/06* (2013.01); *H01J 19/32* (2013.01); *H01J 19/38* (2013.01); *H01J 19/70* (2013.01); *H01J 21/10* (2013.01)

(58) Field of Classification Search

CPC .. H01J 21/06; H01J 21/10; H01J 19/32; H01J 19/38; H01J 19/70

See application file for complete search history.

(56) References Cited

U.S. PATENT DOCUMENTS

2008/0267354 A1* 10/2008 Holm ..... H01J 33/00 378/122

FOREIGN PATENT DOCUMENTS

| | | |
|---|---|---|
| JP | 49-005240 | 2/1974 |
| JP | 2007-042480 | 2/2007 |

OTHER PUBLICATIONS

U.S. Appl. No. 15/000,353 to Kazunori Tatsuda et al., which was filed on Jan. 19, 2016.

Noritake Itron Corporation, "Guide to VFD Operation I Application Note Drive Characteristic", Dec. 19, 2014, https://www.noritake-itron.jp/cs/appnote/apf100_vfd/apf201_houshiki.html.

* cited by examiner

*Primary Examiner* — Anne Hines

(74) *Attorney, Agent, or Firm* — Greenblum & Bernstein, P.L.C.

(57) ABSTRACT

An object of the present invention is to provide a vacuum tube with a structure close to that of an inexpensive and easily available vacuum fluorescent display which easily operates as an analog amplifier. A vacuum tube subject to the present invention comprises: a filament which is tensioned linearly and emits thermoelectrons, an anode arranged parallel to the filament, and a grid arranged between the filament and the anode such that the grid faces the anode. The present invention is characterized in that a distance between the filament and the grid is between 0.2 mm and 0.6 mm, including 0.2 mm and 0.6 mm.

7 Claims, 6 Drawing Sheets

VACUUM TUBE

TECHNICAL FIELD

The present invention relates to a vacuum tube which operates as an analog amplifier.

BACKGROUND ART

A vacuum fluorescent display is known as a technique related to a vacuum tube, and, for example, structures shown in Japanese Utility Model Publication No. 49-5240 (hereinafter referred to as "Patent Literature 1") and Japanese Patent Application Laid Open No. 2007-42480 (hereinafter referred to as "Patent Literature 2") are known. In Patent Literature 1, a linearly tensioned filament which emits thermoelectrons at a predetermined temperature or higher is referred to as "a heater H". An anode arranged parallel to the filament ("a positive pole 4" in Patent Literature 1), and a grid arranged between the filament and the anode such that the grid faces the anode are provided (see FIGS. 1 and 2 of Patent Literature 1). A basic structure in Patent Literature 2 is the same as that of Patent Literature 1. As a control method for the vacuum fluorescent display shown in Patent Literatures 1 and 2, a driving system shown in "Vacuum Fluorescent Display (VFD) General Application Notes—Driving Method—Driving system" by NORITAKE ITRON CORP, searched on the Internet (<https://www.noritake-itron.jp/cs/appnote/apf100_vfd/apf201_houshiki.html>) on Dec. 19, 2014 (hereinafter referred to as Reference Document 1) is known.

SUMMARY OF THE INVENTION

Because there is a demand from users who like characteristics of a vacuum tube mainly in the music industry, there is a demand for a vacuum tube to be used as an analog amplifier, and a vacuum tube which can be used as an analog amplifier exists. For most of general analog amplifiers, however, a semiconductor such as a transistor and an operational amplifier is used. Therefore, the quantity of production of vacuum tubes to be used as analog amplifiers decreases, and there are problems of increase in price and difficulty in availability. On the other hand, a vacuum fluorescent display, which is a kind of vacuum tube and is available inexpensively, is digitally controlled as is known from the driving system shown in Reference Literature 1 and is not designed for use as an analog amplifier. Therefore, the vacuum fluorescent display is not easily used for analog amplification.

An object of the present invention is to provide a vacuum tube with a structure close to that of an inexpensive and easily available vacuum fluorescent display, which is easily operated as an analog amplifier.

A vacuum tube subject to the present invention comprises: a filament which is tensioned linearly and emits thermoelectrons, an anode arranged parallel to the filament, and a grid arranged between the filament and the anode such that the grid faces the anode. The present invention is characterized in that a distance between the filament and the grid is between 0.2 mm and 0.6 mm, including 0.2 mm and 0.6 mm.

According to a feature of the vacuum tube of the present invention, since a flow of electrons from a filament to an anode can be changed in an analog manner by electric potential of a grid, the vacuum tube is easy to use as an analog amplifier.

DETAILED DESCRIPTION OF THE EMBODIMENT

Figure 1:
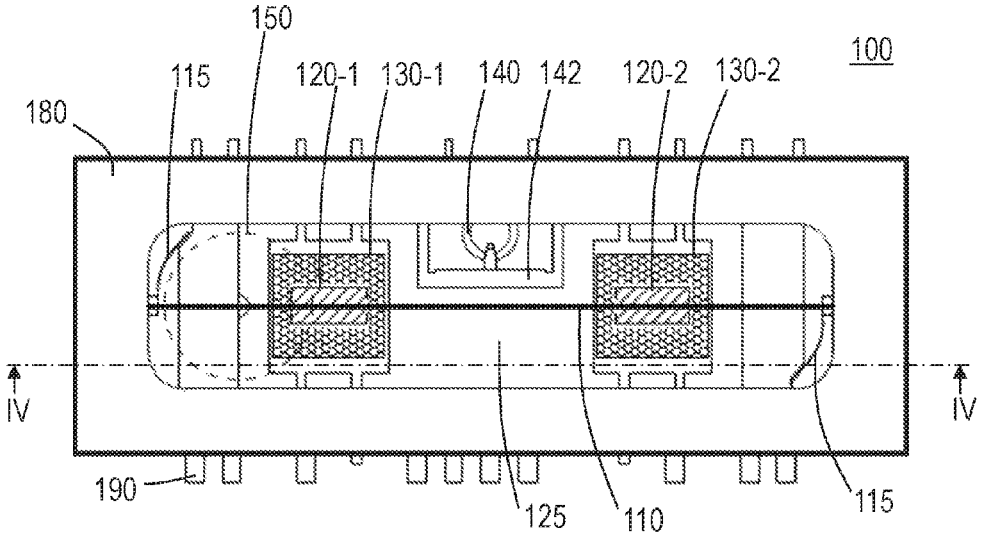
FIG. 1 is a plan view of a vacuum tube of a first embodiment.

An embodiment of the present invention will be described below in detail. Components having the same function are given the same reference numerals, and repeated description will be omitted.

First Embodiment

Figure 2:
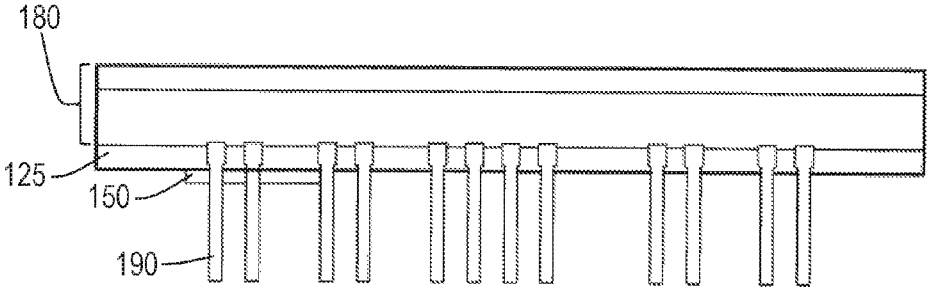
FIG. 2 is a front view of the vacuum tube of the first embodiment.
Figure 3:
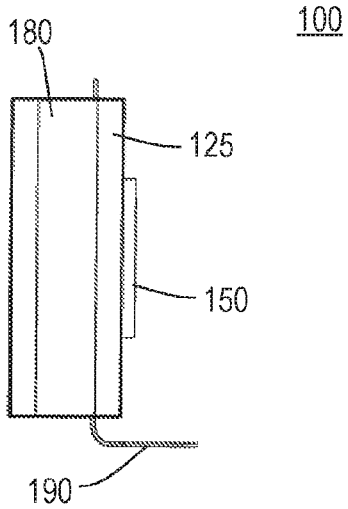
FIG. 3 is a side view of the vacuum tube of the first embodiment.
Figure 4:
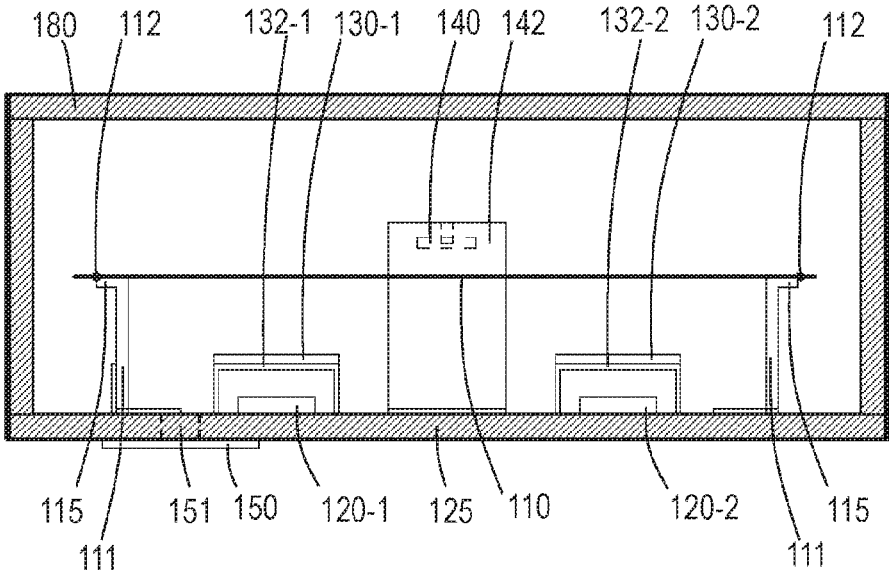
FIG. 4 is a cross-sectional view at a IV-IV line in FIG. 1.

A plan view, front view and side view of a vacuum tube of a first embodiment are shown in FIG. 1, FIG. 2 and FIG. 3, respectively, and a cross-sectional view at a IV-IV line in FIG. 1 is shown in FIG. 4. FIG. 4 is vertically enlarged so that a structure can be easily understood. Though the ratio of vertical direction to horizontal direction is different between FIG. 2 and FIG. 4, it is actually the same. A vacuum tube 100 comprises: a filament 110 which is tensioned linearly and emits thermoelectrons at a predetermined temperature or higher, anodes 120-1, 120-2 arranged parallel to the filament 110, a grid 130-1 arranged between the filament 110 and the anode 120-1 such that the grid 130-1 faces the anode, and a grid 130-2 arranged between the filament 110 and the anode 120-2 such that the grid 130-2 faces the anode. It is a (first) feature that a distance between the filament 110 and the grids 130-1, 130-2 is between 0.2 mm and 0.6 mm, including 0.2 mm and 0.6 mm. Furthermore, it may be a (second) feature that a distance between the anodes 120-1, 120-2 and the grids 130-1, 130-2 may be between 0.15 mm and 0.35 mm, including 0.15 mm and 0.35 mm. It may be a third feature that a fundamental frequency of characteristic vibration of the filament 110 is, 3 kHz or higher. Further, the anodes

120-1, 120-2 are formed on the same face of a glass substrate 125, which is a planar substrate, and a distance between the anode 120-1 and the grid 130-1 is the same as a distance between the anode 120-2 and the grid 130-2. Parts of the grids 130-1, 130-2 are not shown in FIG. 1 so that positions of the anodes 120-1, 120-2 are recognized. In the actual vacuum tube 100, the anodes 120-1, 120-2 are difficult to see because the mesh-type grids 130-1, 130-2 (see FIG. 9) exist on the anodes 120-1, 120-2.

Figure 5:
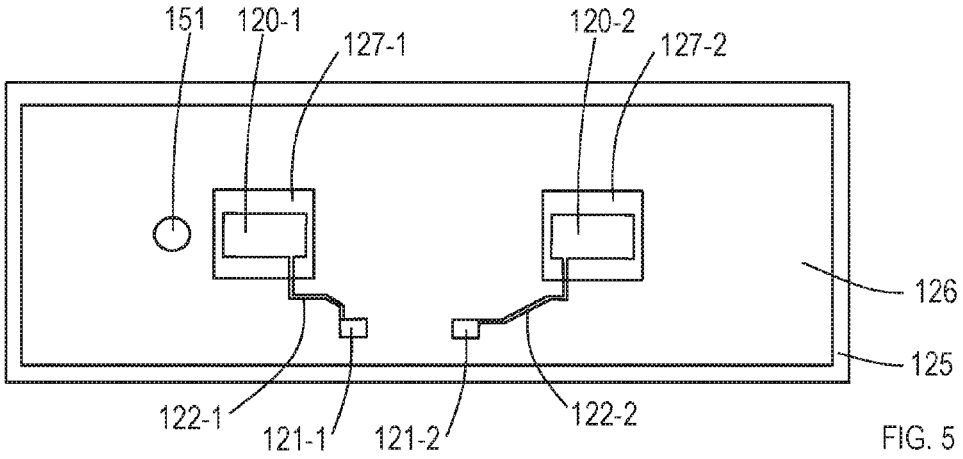
FIG. 5 is a diagram showing that anodes and an insulating layer are formed on a glass substrate.
Figure 6:
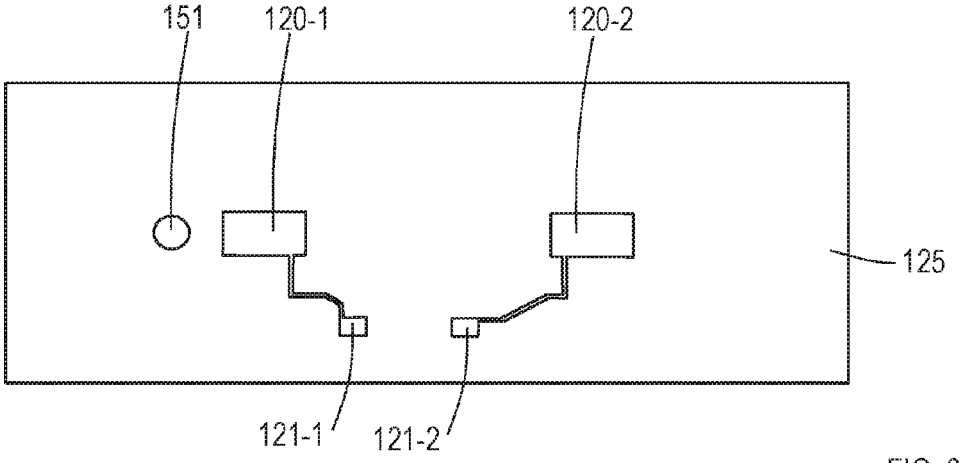
FIG. 6 is a diagram showing that the anodes are formed on the glass substrate.
Figure 7:
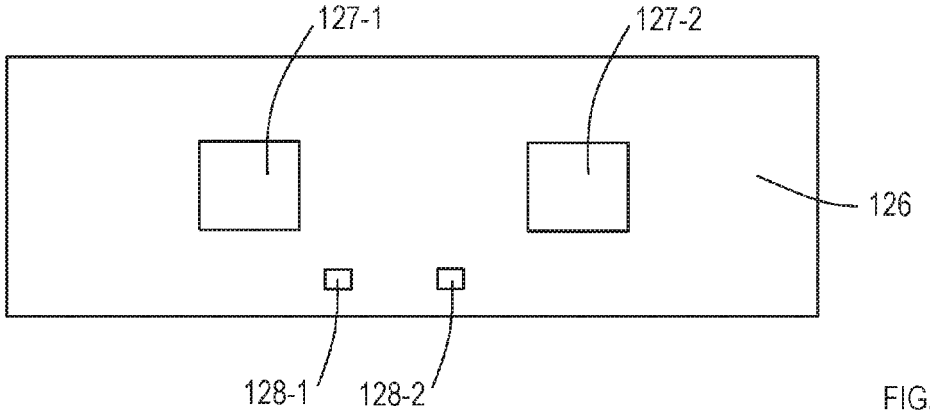
FIG. 7 is a diagram showing the shape of the insulating layer.

Next, a specific example of a structure for realizing the above features will be described. FIG. 5 shows that the anodes 120-1, 120-2 and an insulating layer are formed on a glass substrate. FIG. 6 is a diagram showing that the anodes 120-1, 120-2 are formed on the glass substrate. FIG. 7 is a diagram showing the shape of the insulating layer. The glass substrate 125 has an exhaust hole 151. The anodes 120-1, 120-2 are formed on one face of the glass substrate 125. Anode terminals 121-1, 121-2 are connected to the anodes 120-1, 120-2. The anodes 120-1, 120-2 can be formed, for example, with a thin film of aluminum. For an insulating layer 126, for example, low-melting-point glass can be used, and the insulating layer 126 has anode openings 127-1, 127-2 and terminal openings 128-1, 128-2. The vacuum tube 100 is evacuated by sealing a case 180 and the glass substrate 125 and evacuating air through the exhaust hole 151. Then, an exhaust hole plug 150 is fitted in the exhaust hole 151. Low-melting-point glass for sealing may be further arranged on a part of the glass substrate 125 to be in contact with the case 180 though it is not shown in FIG. 5. Electrical contact with the outside is achieved by a terminal 190.

Figure 8:
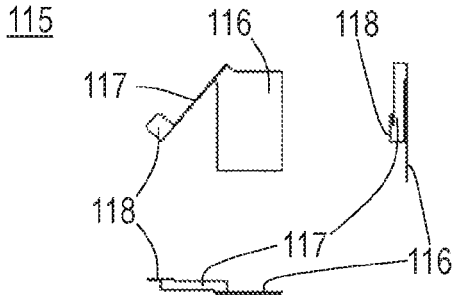
FIG. 8 shows three views (a plan view, a front view and a side view) of an anchor.

The filament 110 is a directly heated cathode. For example, the, filament 110 can be coated with barium oxide so that thermoelectrons are emitted when the filament 110 is heated to about 650 degrees by causing a direct current to flow. In this example, the "predetermined temperature or higher" described above is 650 degrees, but the temperature is not limited to 650 degrees. FIG. 8 shows three views (a plan view, front view and side view) of an anchor 115 for giving tension to the filament 110. One end of a plate spring 117 is arranged on a part of an anchor body 116, and the other end of the plate spring 117 is a filament fixing part 118. For the anchor 115, SUS (stainless steel material) or the like can be used. The anchors 115 are fitted to filament support members 111, and the filament 110 is fixed to the filament fixing parts 118 of the anchors 115 by welding or the like. Reference numeral 112 in FIG. 4 indicates welding points. A distance between the filament 110 and the anodes 120-1, 120-2 is determined by the length of the filament support members 111, and the tension of the filament 110 can be adjusted by the plate springs 117 of the anchors 115.

Figure 9:
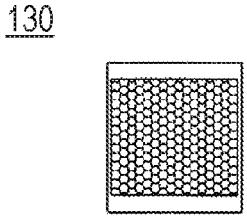
FIG. 9 is a diagram showing an example of the shape of a grid.

FIG. 9 shows an example of the shape of a grid. A grid 130 is mesh-shaped and can be formed with SUS or the like. As described above, parts of the grids 130 are not shown in FIG. 1 in order to show the anodes 120-1, 120-2 recognizably. The actual grids 130-1, 130-2 are the grid 130 shown in FIG. 9. Further, the grids 130-1, 130-2 are fixed to grid support members 132-1, 132-2. The distance between the anodes 120-1, 120-2 and the grids 130-1, 130-2 and the distance between the filament 110 and the grids 130-1, 130-2 are determined according to board thickness of the grid support members 132-1, 132-2.

Specifically, in the vacuum tube 100, the distance between the anodes 120-1, 120-2 and the grids 130-1, 130-2, which is between 0.15 mm and 0.35 mm, including 0.15 mm and 0.35 mm, is realized by the grid support members 132-1, 132-2. The distance between the filament 110 and the grids 130-1, 130-2, which is between 0.2 mm and 0.6 mm, including 0.2 mm and 0.6 mm, is realized by the filament support members 111 and the grid support members 132-1, 132-2. Further, the fundamental frequency of the characteristic vibration of the filament 110, which is 3 kHz or higher, can be realized by adjusting material and thickness of the filament 110, the length between the welding points 112 and the tension given by the anchors 115. It is desirable that the fundamental frequency is high, and if the fundamental frequency can be adjusted to be 10 kHz or higher, it is possible to prevent noises due to the vibration of the filament from being heard by a person.

Figure 10:
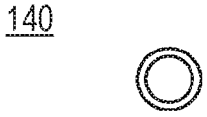
FIG. 10 is a diagram showing a getter ring.

FIG. 10 shows a getter ring 140. The getter ring 140 is responsible for enhancing a degree of vacuum or keeping the degree of vacuum by flushing induced by high frequency induction heating and depositing a metallic barium film on a part of the case 180. A getter shield 142 is a member for masking the getter ring 140 against the filament 110, the grids 130-1, 130-2 and the anodes 120-1, 120-2. In the case of a vacuum fluorescent display, influence to the characteristics of an indicator can be ignored no matter where the getter ring is arranged in the case, and, therefore, it is not necessary to consider a position of the getter ring from a viewpoint of the characteristics. However, it turned out that, in the case of using two pairs, the pair of the anode 120-1 and the grid 130-1 and the pair of the anode 120-2 and the grid 130-2, as amplifiers for stereo signals, the influence of the getter ring 140 cannot be ignored in order to balance the characteristics of the two pairs of amplifiers. Therefore, it is desirable to arrange the getter ring 140 at equal distances from the grids 130-1, 130-2 in order to balance the characteristics of the two pairs of amplifiers.

Figure 11:
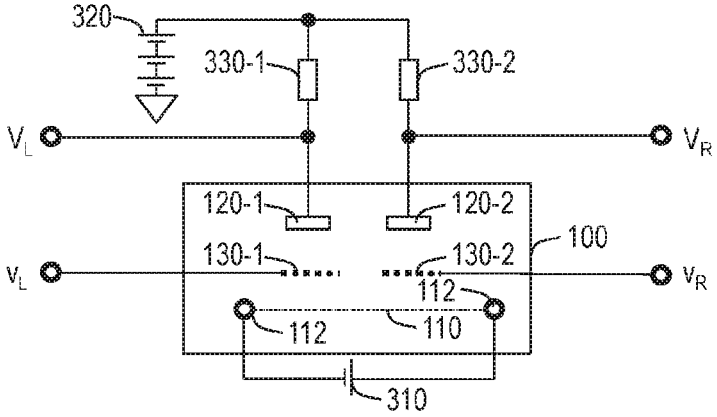
FIG. 11 is a diagram showing an example of an amplification circuit using the vacuum tube.

FIG. 11 shows an example of an amplification circuit using the vacuum tube 100. A DC voltage source 310 (for example, 0.7 V) is connected to the filament 110, and the filament 110 is heated to a predetermined temperature at which thermoelectrons are emitted (for example, 650 degrees). An anode voltage source 320 is applied to the anodes 120-1, 120-2 via resistances 330-1, 330-2. Then, for example, a signal $v_L$ of a left channel of a stereo to which a predetermined bias is added is input to the grid 130-1, and a signal $v_R$ of a right channel of the stereo to which the same bias is added is input to the grid 130-2. In this case, a voltage $V_L$ of the anode terminal 121-1 is an output for the left channel, and a voltage $V_R$ of the anode terminal 121-2 is an output for the right channel.

Figure 12:
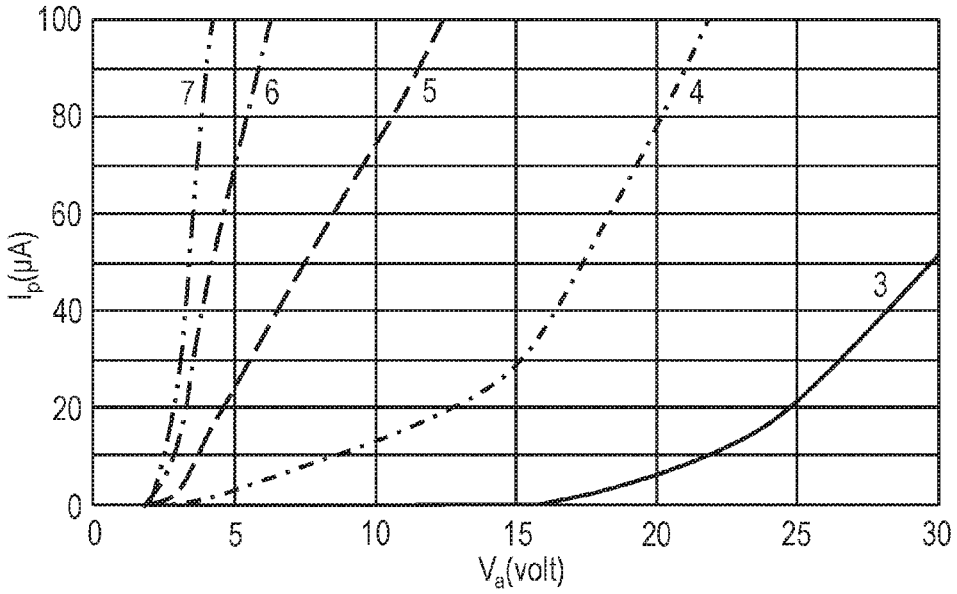
FIG. 12 is a diagram showing a relationship between an anode voltage $V_a$ and a current $I_p$ in a vacuum fluorescent display for each voltage of the grid.

Next, the necessity of the features of the present invention will be described. A general vacuum fluorescent display also comprises: a filament which is tensioned linearly and emits thermoelectrons at a predetermined temperature or higher, an anode arranged parallel to the filament, and a grid arranged between the filament and the anode such that the grid faces the anode. In the general vacuum fluorescent display, however, a distance between the anode and the grid is about 0.5 mm or more, and a distance between the filament and the grid is about 1.0 mm or more. Further, the fundamental frequency of the characteristic vibration of the filament is not considered. In the case of the vacuum fluorescent display, ON/OFF control is performed, and, therefore, it is necessary to avoid a current from flowing insufficiently when the voltage of the grid is changed. That's why the above lengths are adopted. FIG. 12 shows a relationship between an anode voltage $V_a$ and a current $I_p$ in a vacuum fluorescent display for each voltage. Numerical values shown beside lines in FIG. 12 indicate the voltage of the grid. In the vacuum fluorescent display used in this experiment, the distance between the anode and the grid is about 0.5 mm, and the distance between the filament and the grid is about 1.0 mm. When the anode voltage $V_a$ is 10V, an insufficient current flows if the voltage of the grids is in the vicinity of 4V. The current is turned off if the voltage of the grid is 3V or below and turned on if the voltage of the grid is 5V or higher. Even if the voltage of the grid is changed in the vicinity of 4V, a range within which linearity can be obtained is thought to be narrow, and as can be seen, it is not easy to utilize the vacuum fluorescent display for analog amplification. There is a possibility that a region where linearity can be obtained exists in a region where the anode voltage $V_a$ is higher than 30V. However, since it is necessary to continuously apply anode voltage in order to utilize the vacuum fluorescent display as an analog amplifier, the anode voltage $V_a$ cannot be so increased given the influence of thermal expansion. In addition, in the case of using the vacuum fluorescent display as a vacuum fluorescent display, it is not necessary to continuously apply anode voltage because human afterimage is also utilized. In other words, it is also a cause of difficulty in utilization as an analog amplifier in comparison with utilization as a vacuum fluorescent display that the anode voltage cannot be increased.

Figure 13:
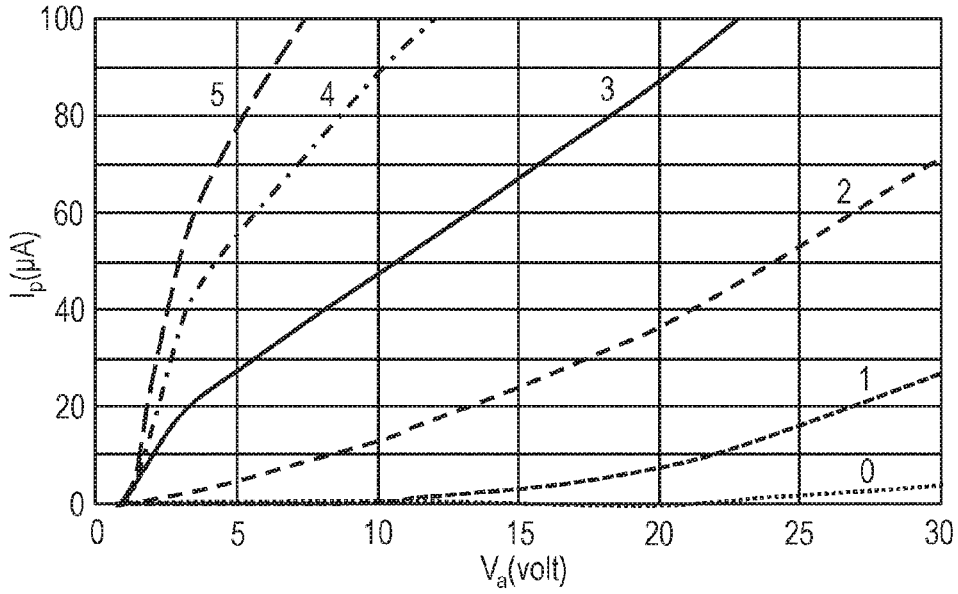
FIG. 13 is a diagram showing the relationship between the anode voltage $V_a$ and the current $I_p$ in the case where a distance between the anode and the grid is set to about 0.3 mm and a distance between a filament and the grid is set to about 0.4 mm, for each voltage of the grid.

FIG. 13 shows the relationship between the anode voltage $V_a$ and the current $I_p$ in the case where the distance between the anode the grid is set to about 0.3 mm, and the distance between the filament and the grid is set to about 0.4 mm, for each voltage. As can be seen from FIG. 13, a substantially linear amplification characteristic can be obtained within a range where the anode voltage $V_a$ is about 4V or higher if a bias voltage of an input signal is 3V, and a maximum value of amplitude of an input signal is 1V. Therefore, the vacuum tube is easy to utilize as a vacuum tube for analog amplification. Though an experiment example shown in the present application is shown only in FIG. 13, a vacuum tube which is easy to utilize for analog amplification in comparison with the general vacuum fluorescent display described with reference to FIG. 12 can be obtained if the distance between the filament 110 and the grids 130-1, 130-2 is between 0.2 mm and 0.6 mm, including 0.2 mm and 0.6 mm. In other words, according to the (first) feature of the vacuum tube of the present invention, since a flow of electrons from a filament to an anode can be changed in an analog manner by electric potential of a grid, the vacuum tube is easy to use as an analog amplifier.

Further, in the case where the distance between the anodes 120-1, 120-2 and the grids 130-1, 130-2 exceeds 0.35 mm, it is necessary that the grid support members 132-1, 132-2 are bent-formed. On the other hand, if the distance between the anodes and the grids is between 0.15 mm and 0.35 mm, including 0.15 mm and 0.35 mm, the grid support members 132-1, 132-2 can be configured only by performing blanking of a flat board. In this case, since the distance between the anodes and the grids is determined by the board thickness of the grid support members, the grid support members 132-1, 132-2 can be formed with an accurate distance. Further, if the grid support members 132-1, 132-2 are bent-formed, the grids easily vibrate and cause noises. If the grid support members 132-1, 132-2 are formed by flat board punching, the vibration of the grids can be suppressed, and a vacuum tube which is easy to utilize for analog amplification can be obtained.

As described above, according to the third feature of the vacuum tube of the present invention, the vacuum tube is easy to use as an analog amplifier for amplifying a sound signal because a noise frequency resulting from the vibration of the filament is higher than a frequency audible to a person. If a function of removing the influence of the vibration of the filament 110 is provided outside the vacuum tube, it is possible to configure an analog amplifier which can be used for a sound signal only by the first feature.

Modification

Figure 14:
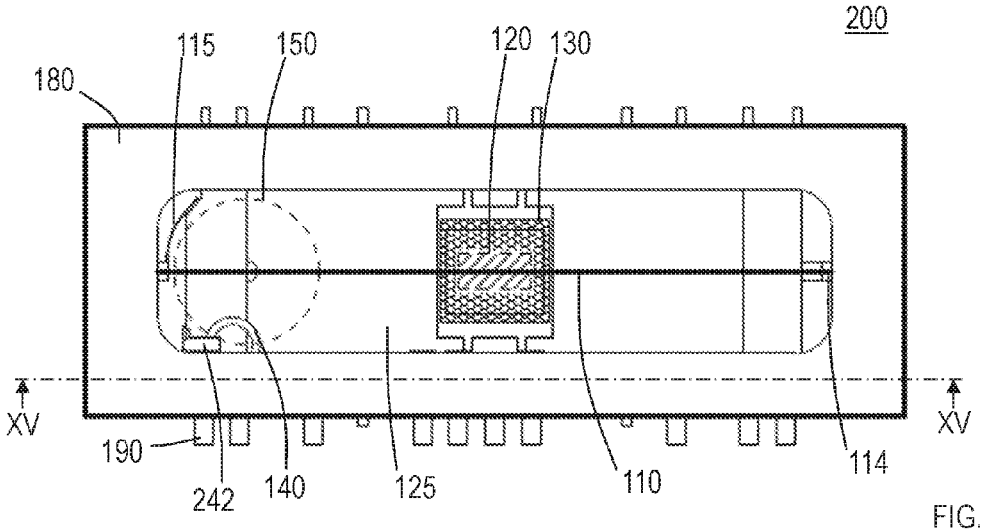
FIG. 14 is a plan view of a vacuum tube of a modification.
Figure 15:
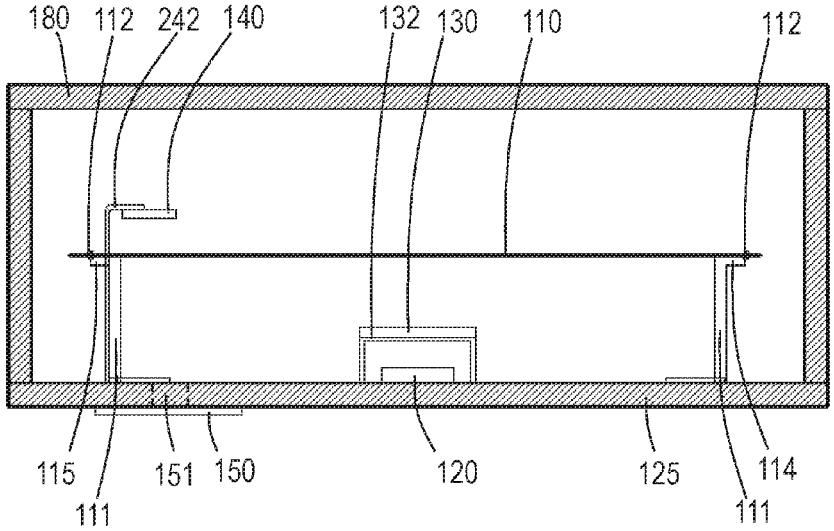
FIG. 15 is a cross-sectional view at a XV-XV line in FIG. 14.

FIG. 14 shows a plan view of a vacuum tube of a modification, and FIG. 15 shows a cross-sectional view at a XV-XV line in FIG. 14. FIG. 15 is vertically enlarged so that a structure can be easily understood. A vacuum tube 200 is different from the vacuum tube 100 in a point that there is only one pair of an anode 120 and a grid 130, a position of the getter ring 140, and a method of fixing the filament 110. In FIG. 14 also, a part of the grid 130 is not shown so that the position of the anode 120 can be easily recognized. The grid 130, however, is the same as FIG. 9. In the vacuum tube 200, it is not necessary to limit the position of the getter ring 140 to adjust the characteristics because there is only one pair of the anode 120 and 130. Therefore, the getter ring 140 is fitted to an end of the vacuum tube 200 in a state of being held by a getter ring support member 242.

In the vacuum tube 200, the anchor 115 is attached only to one of the filament support members 111. In the case of the filament support member 111 to which the anchor 115 is not attached, the filament 110 can be fixed to a filament fixing part 114 of the filament support member 111 by welding or the like. In the vacuum tube 100 also, the anchor 115 may be attached only to one of the filament support members. The anchors 115 may be attached to both filament support members in the vacuum tube 200 also.

The vacuum tube 200 also comprises: a filament 110 which is tensioned linearly and emits thermoelectrons at a predetermined temperature or higher, an anode 120 arranged parallel to the filament 110, and a grid 130 arranged between the filament 110 and the anode 120 such that the grid 130 faces the anode, though this is a description common to the vacuum tube 200 and the vacuum tube 100. It is a first feature that a distance between the filament 110 and the grid 130 is between 0.2 mm and 0.6 mm, including 0.2 mm and 0.6 mm. It is a second feature that a distance between the anode 120 and the grid 130 is between 0.15 mm and 0.35 mm, including 0.15 mm and 0.35 mm. It is a third feature that the fundamental frequency of the characteristic vibration of the filament 110 is 3 kHz or higher. Obtained advantageous effects are the same as those of the first embodiment.

What is claimed is:

1. A vacuum tube comprising:

a filament tensioned linearly and emitting thermoelectrons;

an anode arranged parallel to the filament; and a grid arranged between the filament and the anode such that the grid faces the anode; wherein a distance between the filament and the grid is between 0.2 mm and 0.6 mm, including 0.2 mm and 0.6 mm.

2. The vacuum tube according to claim 1, wherein a distance between the anode and the grid is between 0.15 mm and 0.35 mm, including 0.15 mm and 0.35 mm.

3. The vacuum tube according to claim 2, wherein two pairs of the anode and the grid are provided;

both of the anodes are formed on the same face of a planar substrate; and the distance between the anode and the grid is the same in the two pairs.

4. The vacuum tube according to claim 3, further comprising:

a getter ring for keeping a degree of vacuum in the vacuum tube; and a getter shield for masking the getter ring against the filament, the grids and the anodes; wherein the getter ring is arranged at equal distances from each of the grids.

5. The vacuum tube according to claim 1, wherein two pairs of the anode and the grid are provided;

both of the anodes are formed on the same face of a planar substrate; and the distance between the anode and the grid is the same in the two pairs.

6. The vacuum tube according to claim 5, further comprising:

a getter ring for keeping a degree of vacuum in the vacuum tube; and a getter shield for masking the getter ring against the filament, the grids and the anodes; wherein the getter ring is arranged at equal distances from each of the grids.

7. The vacuum tube according to any of claim 1, wherein a fundamental frequency of characteristic vibration of the filament is 3 kHz or higher.

* * * * *